US007938292B2

(12) United States Patent
Chornenky

(10) Patent No.: US 7,938,292 B2
(45) Date of Patent: May 10, 2011

(54) MODIFIED PAINT CAN WITH THUMB HOLE

(76) Inventor: Daniel Chornenky, Elizabeth, PA (US)

( * ) Notice: Subject to any disclaimer, the term of this patent is extended or adjusted under 35 U.S.C. 154(b) by 170 days.

(21) Appl. No.: 12/287,872

(22) Filed: Oct. 14, 2008

(65) Prior Publication Data

US 2009/0095760 A1 Apr. 16, 2009

Related U.S. Application Data

(60) Provisional application No. 60/999,136, filed on Oct. 15, 2007.

(51) Int. Cl.
*B65D 8/04* (2006.01)
*B65D 90/02* (2006.01)

(52) U.S. Cl. ..... 220/676; 220/770

(58) Field of Classification Search ..... 220/635, 220/636, 669, 676, 770, 771
See application file for complete search history.

(56) References Cited

U.S. PATENT DOCUMENTS

| | | | | |
|---|---|---|---|---|
| 3,198,377 | A * | 8/1965 | Buckley | 220/771 |
| 4,967,918 | A * | 11/1990 | Long | 215/385 |
| 6,412,661 | B1 * | 7/2002 | Hannah, Sr. | 222/111 |
| 6,983,862 | B2 * | 1/2006 | Nottingham et al. | 222/109 |
| 2009/0032542 | A1 * | 2/2009 | Temple | 220/669 |

* cited by examiner

*Primary Examiner* — Anthony Stashick
*Assistant Examiner* — Harry A Grosso
(74) *Attorney, Agent, or Firm* — James Ray & Assoc

(57) ABSTRACT

A paint can with a thumb hole disposed therein as an aid in holding such paint can in one hand. The thumb hole has a different shape when designed for use with a gallon can as opposed to the thumb hole when designed for use with a quart can or smaller.

11 Claims, 3 Drawing Sheets

MODIFIED PAINT CAN WITH THUMB HOLE

CROSS REFERENCE TO RELATED APPLICATIONS

This application is closely related to and claims benefit from U.S. Provisional Application Ser. No. 60/999,136 filed Oct. 15, 2007.

FIELD OF THE INVENTION

The present invention relates, in general, to a paint can, and, more particularly, the present invention relates to a modified paint can that has a thumb or a finger hole disposed therein as an aid to holding such can while painting.

BACKGROUND OF THE INVENTION

Holding a can of paint and painting from either a quart or a gallon can at the same time is not easy. This is due primarily to the design and shape of the paint can. With a quart can one can place the can in the palm and squeeze the can to hold it, or possibly hold the can with the palm on the bottom and thumb on the rim and squeeze. Because of their smaller hand size most women will find all of this difficult. With more women becoming involved in painting this presents an even greater problem.

As difficult as it is to hold a quart can and painting at the same time the problem is even more magnified if one uses a gallon can.

Thus, it would be advantageous and convenient if there were a means for holding such paint cans without the strain that is presently encountered and still have a hand free to paint with.

SUMMARY OF THE INVENTION

In a first aspect the invention provides a paint can with a thumb hole disposed therein as an aid in holding such paint can in one hand. The thumb hole can have a different shape when designed for use with a gallon can as opposed to the thumb hole when designed for use with a quart can or smaller.

OBJECTS OF THE INVENTION

It is, therefore, one of the primary objects of the present invention to provide a paint can that can be held in one hand easily.

Another object of the present invention is to provide a paint can that is modified without detracting substantially from the cans contents.

Still another object of the present invention is to provide a modified paint can that is inexpensive to make.

Yet another object of the present invention is to provide a modified paint wherein a secure grip can be obtained.

Another object of the present invention is to provide a plastic paint container that can be held with one by having a thumb hole molded therein.

These and various other objects and advantages of this invention will become apparent after a full reading of the following detailed description, particularly, when read in conjunction with the attached drawings as described below and the appended claims.

Figure 1:
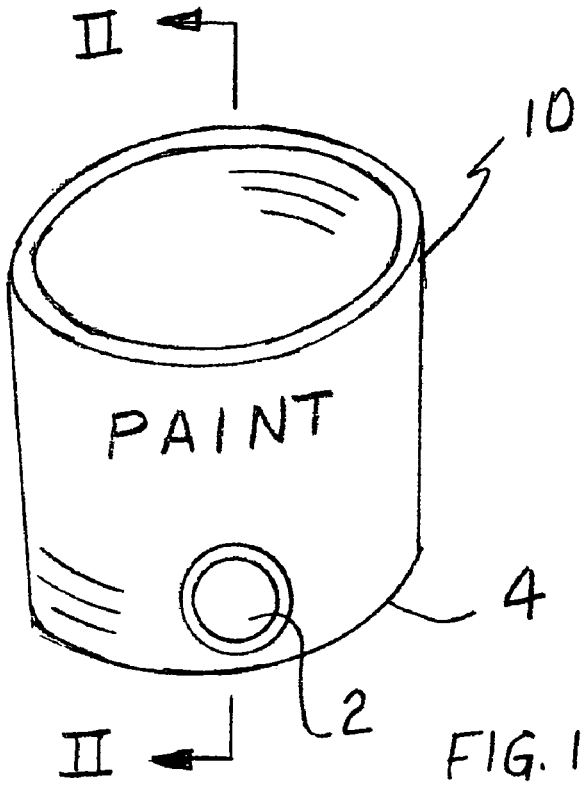
FIG. 1 is a perspective view of a quart paint can with a thumb hole disposed therein according to an embodiment of the invention.

BRIEF DESCRIPTION OF THE PRESENTLY PREFERRED AND ALTERNATE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

Figure 2:
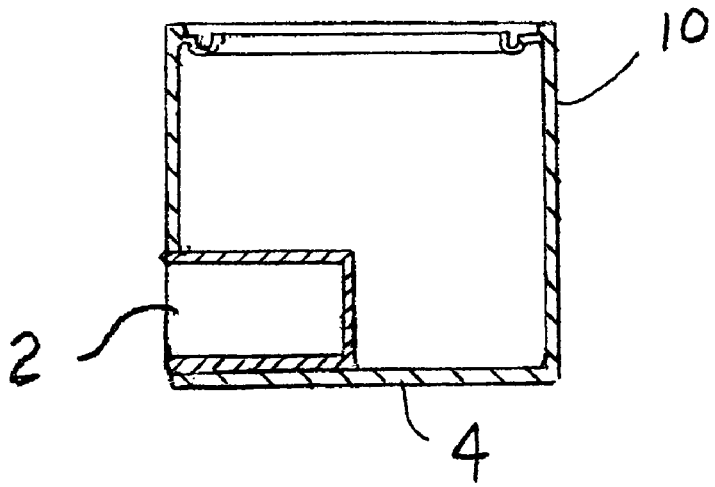
FIG. 2 is a cross sectional view of the paint can shown in FIG. 1.

In a first aspect the invention provides, as seen in FIGS. 1 and 2, a modification to a paint container, generally designated 10, in which such container 10 is provided with a thumb hole 2 to assist a user in holding the a paint container in one hand while having the other hand free to paint with. This embodiment is designed for use with a quart paint container. The thumb fits in the thumb hole 2 parallel to the base 4 of the container 10 and the container 10 rests on the palm of the hand so that the container is conveniently held with only one hand leaving the other hand free to hold a paint brush and paint whatever is being painted.

Figure 3:
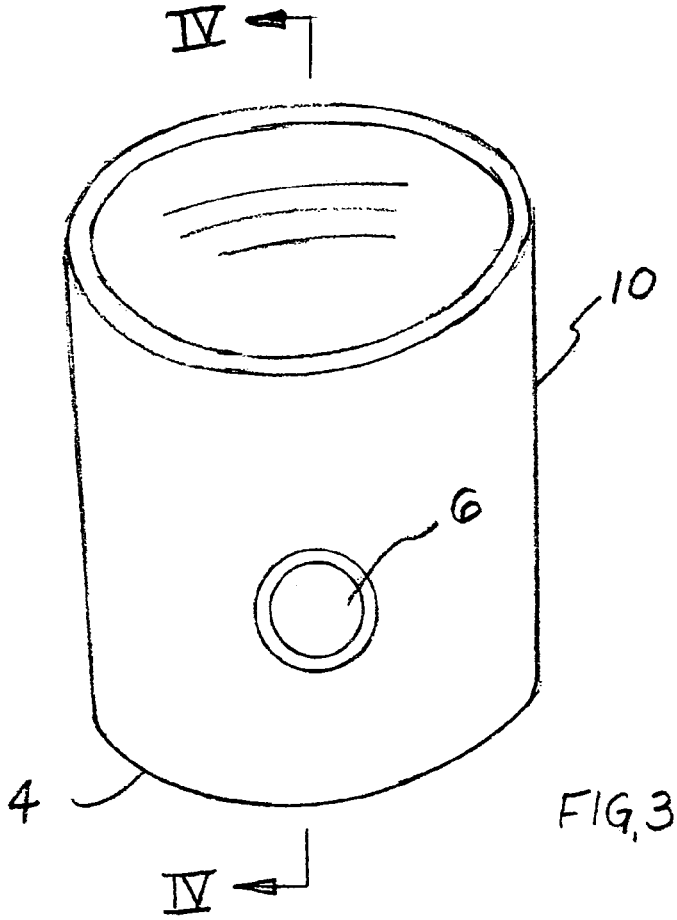
FIG. 3 is a perspective view of a gallon paint can with a thumb hole disposed therein according to an alternate embodiment of the invention.
Figure 4:
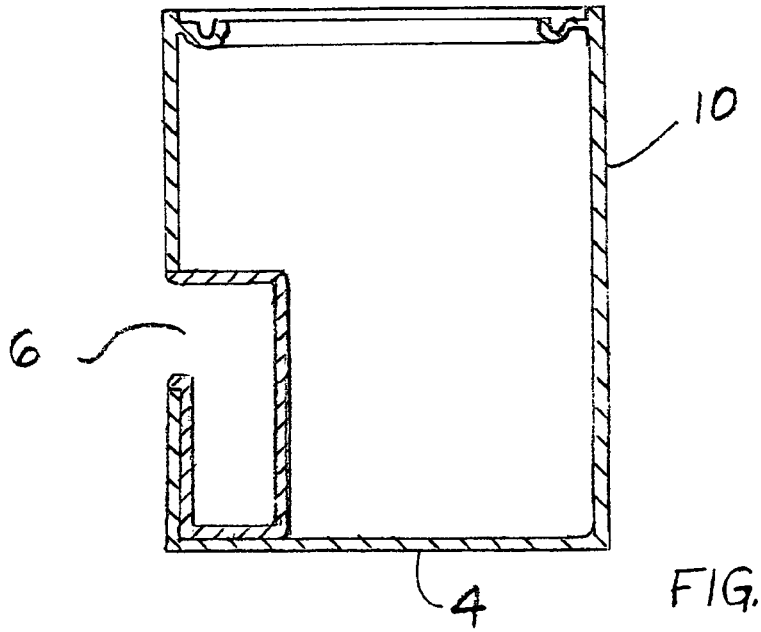
FIG. 4 is a cross sectional view of the paint can shown in FIG. 3.

In a second embodiment designed for use with gallon containers as seen in FIGS. 3 and 4. In this embodiment the thumb hole 6 is not quite as deep as was evident in the thumb hole 2 for quart containers. However, the thumb hole 6 in this embodiment is higher which permits the thumb to be bent at approximately a right angle so as to provide more support since the container is not only larger but heavier.

In the embodiment for the quart container 10 the predetermined size of an opening for the thumb hole 2 is between about 7/16 and about 11/16 inches. And the depth of the hole 2 is between about 1⅛ inches and about 1⅜ inches deep. The thumb hole 2 is disposed closely adjacent the bottom edge of the container and as stated previously the thumb hole 2 is substantially parallel to the base 4 of the container. In this embodiment for quart containers 10 such specially configured thumb hole 6 is substantially parallel to such base 4 of such container member 10.

In the embodiment for the gallon container 10 the thumb hole 6 has an opening that is between about 11/16 and about 15/16 inches and has a depth of between about 15/16 and about 1 1/16 inches. However, the hole has a height above the base 4 of the container 10 of between about 1⅞ and about 2⅜ inches. The opening in this embodiment is disposed between about 1 inch and about 1⅜ inches above the base 4 of the container 10. Again as stated previously, in this embodiment the thumb hole 6 is not quite as deep as was evident in the thumb hole 2 for quart containers. However, the thumb hole 6 in this embodiment is higher (from the base 4 of the container member 10) which permits the thumb to be bent at approximately a right angle so as to provide more support since the gallon container 10 is not only larger but heavier and thus better support is required. In this embodiment for gallon containers 10 such specially configured thumb hole 6 is substantially perpendicular to the base 4 of the container member 10.

Figure 5:
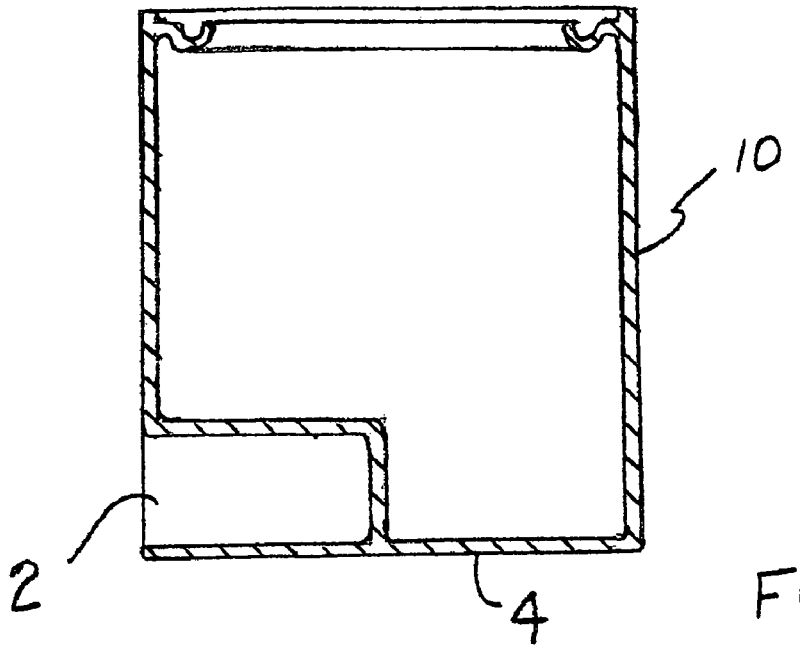
FIG. 5 is a cross sectional view of a quart plastic paint container with a thumb hole molded therein according to an embodiment of the invention.
Figure 6:
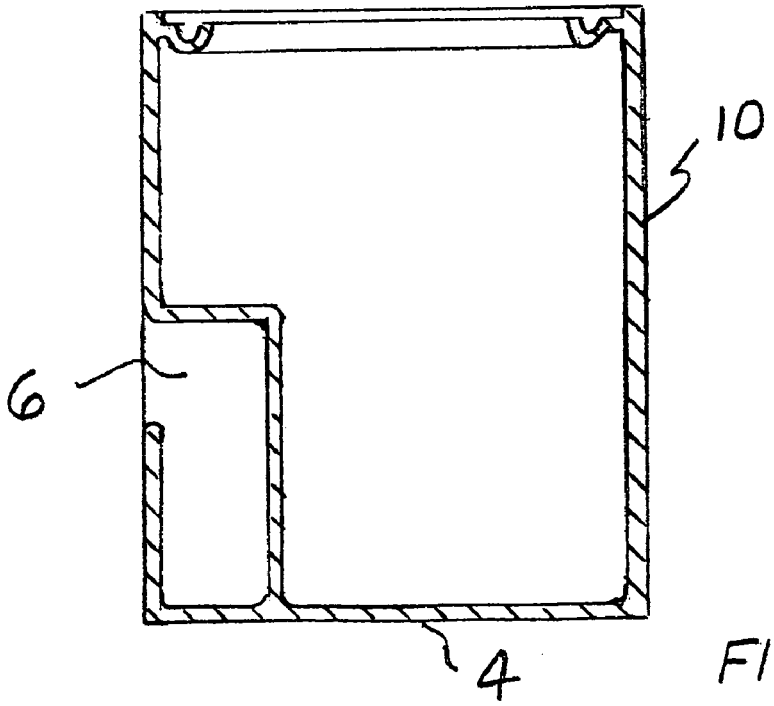
FIG. 6 is a cross sectional view of a gallon plastic paint container with a thumb hole molded therein according to an embodiment of the invention.

FIGS. 5 and 6 show the present invention as applied to plastic paint containers. FIG. 5 shows a quart container wherein the thumb hole is molded right into the can. As is evident the bottom portion of the thumb hole is the base of the container. In the case of the gallon container as seen in FIG. 6 the base and side of the container itself forms parts of the thumb hole. Again since this is a plastic container such a hole is molded therein as the container is being formed.

With the present invention a strain free and effortless holding of a paint can becomes a reality. The present invention is used in a manner similar to the way an artist holds a palette. The palette is not just a piece of wood that an artist holds on the outer edges an squeezes between the thumb and palm. The pressure needed to hold the palette in this manner would cause stress, strain and discomfort in a very short time. But someone placed a hole off center on the palette and so the artist basically places his/her thumb through the hole in the palette and holds the palette between the thumb and the palm. Only a small amount of pressure is required to hold the palette and, thus, an artist can paint for hours without straining the hand or thumb.

Similarly by putting a thumb hole in the side of a paint can one can place the thumb into it and rest the can comfortably on the palm. Hardly any pressure is required to give the painter unbelievable control of the paint can. The can almost feels as if it part of the hand.

It should be remembered that a painter never paints from a full can. Over half of the contents of the can is poured into another container or bucket. This leaves room in the can for the brush. Technically, one is never holding more than a pint of paint in a quart container and generally less than two quarts of paint at the most and more probably only about a quart in a gallon container.

When a painter works off a high ladder or even a scaffold the work can be very time consuming and tiring. The painter is always stretching, bending or reaching to get into the paint can. If the container could be held in the hand as is the case with the present invention much of the strain is eliminated and even overhead painting can become a relatively pleasant routine instead of a dreaded struggle.

While a presently preferred embodiment and alternate embodiments of the present invention has been described in detail above, it should be understood that various other adaptations and/or modifications of the invention can be made by those persons who are particularly skilled in the art without departing from either the spirit of the invention or the scope of the appended claims.

I claim:

1. An apparatus for assisting a user in holding a paint can in one hand when such user is in a process of painting said apparatus comprising;

(a) a container member having a predetermined size and shape; and (b) a specially configured thumb hole formed integral with said container member, said thumb hole having each of a predetermined shape, a predetermined depth and a predetermined size, said predetermined shape being substantially cylindrical and having a first portion disposed substantially perpendicular to a base of said container member and a second portion disposed substantially parallel to said base portion, a first end of said first portion located a greater distance from said base portion than a second end thereof and a first end of said second portion communicating with said first end of said first portion.

2. The apparatus, according to claim 1, wherein said specially configured thumb hole is designed for a quart paint container member.

3. The apparatus, according to claim 2, wherein said specially configured thumb hole is disposed closely adjacent a bottom edge of such container.

4. The apparatus, according to claim 1, wherein a predetermined size of an opening in such paint container is between about 7/16 inch and about 11/16.

5. The apparatus, according to claim 2, wherein said predetermined depth is between about 1⅛ and about 1⅜ inches.

6. The apparatus, according to claim 1, wherein said specially configured thumb hole is designed for a gallon paint container member.

7. The apparatus, according to claim 6, wherein a predetermined size of an opening in such paint container is between about 11/16 inch and about 15/16.

8. The apparatus, according to claim 7, wherein said opening is disposed between about 1 inch and about 1⅜ inch above a base of said container member.

9. The apparatus, according to claim 8, wherein said predetermined depth of said thumb hole is between about ¾ and about 1 inch.

10. The apparatus, according to claim 9, wherein said specially configured thumb hole has a height above said base of said container member of between about 1⅞ inches and about 2⅜ inches.

11. The apparatus, according to claim 1, wherein said specially configured thumb hole for a plastic paint container member is molded therein wherein parts of said container member become parts of said specially configured thumb hole.

* * * * *